United States Patent [19]

Yamaguchi et al.

[11] Patent Number: 4,592,407

[45] Date of Patent: Jun. 3, 1986

[54] FULL AUTOMATIC DIE CASTING MACHINE

[75] Inventors: Terumoto Yamaguchi, Anjo; Tuneo Terashima, Nagoya, both of Japan

[73] Assignee: Kabushiki Kaisha Tokai Rika Denki Seisakusho, Aichi, Japan

[21] Appl. No.: 783,054

[22] Filed: Oct. 1, 1985

Related U.S. Application Data

[63] Continuation of Ser. No. 492,993, May 9, 1983, abandoned.

[30] Foreign Application Priority Data

May 10, 1982 [JP] Japan ..... 57-77962

[51] Int. Cl.[4] ..... B22D 17/00

[52] U.S. Cl. ..... 164/265; 164/267; 164/5; 164/269; 164/312; 164/335; 164/344; 164/347

[58] Field of Search ..... 164/131, 270.1, 262, 164/264, 265, 269, 303, 312, 316, 344, 347, 404, 5, 267, 335, 68.1; 53/250; 198/307, 701, 750; 292/163

[56] References Cited

U.S. PATENT DOCUMENTS

| | | | |
|---|---|---|---|
| 1,205,309 | 11/1916 | Wright | 164/269 |
| 1,599,624 | 9/1926 | Stern | 164/347 |
| 1,666,148 | 4/1928 | Rick | 292/163 |
| 2,496,131 | 1/1950 | Morin | 164/262 |
| 2,821,375 | 1/1958 | Andrews | 164/5 |
| 2,946,102 | 7/1960 | Mills | 164/265 |
| 3,271,427 | 9/1966 | Molins | 53/250 |
| 3,765,474 | 10/1973 | Burton | 164/149 |
| 3,888,366 | 6/1975 | Prahst | 198/750 |
| 4,265,297 | 5/1981 | Asakuma | 164/303 |

*Primary Examiner*—Kuang Y. Lin
*Assistant Examiner*—C. McKee
*Attorney, Agent, or Firm*—Jackson & Jones

[57] ABSTRACT

A full automatic die casting machine including a fixed die, a movable die, a melting furnace and an injection cylinder. At least either one of the fixed die and the movable die is provided with a first recess for forming an article and second recess for forming an engageable portion on the article. The die casting machine further includes an article supporting device, a coating device for coating die lubricant on the first recess and the second recess, a finishing device, a packing device and a recycling device.

22 Claims, 20 Drawing Figures

FULL AUTOMATIC DIE CASTING MACHINE

CROSS-REFERENCE

This is a continuation of U.S. patent application Ser. No. 492,993 filed May 9, 1983 for FULLY AUTOMATIC DIE CASTING MACHINE now abandoned.

BACKGROUND OF THE INVENTION

The present invention generally relates to casting machines and more particularly, to a fully automatic die casting machine in which processes of casting molten metal into an article, finishing the article by removing flash, etc. therefrom, packing the articles in a box one box by one box, returning the removed flash, etc. into a melting furnace for reuse thereof, etc. are performed automatically.

Conventionally, in die casting machines, it has been generally so arranged that, after an article has been cast and then, flash, etc. have been removed from the article by a finishing device, the articles are packed in a box. However, the known die casting machines have such inconveniences that, since processes of casting the articles, finishing the article, packing the articles in the box, etc. are performed independently of each other, it becomes troublesome to operate the die casting machines and further, production efficiency of the die casting machines is low.

SUMMARY OF THE INVENTION

Accordingly, an essential object of the present invention is to provide an improved die casting machine in which processes of casting an article, finishing the article, packing the articles in a box one box by one box, etc. are associated with each other so as to simplify operations of the fully automatic die casting machine and remarkably improve production efficiency thereof, with substantial elimination of the disadvantages inherent in conventional fully automatic die casting machines of this kind.

Another important object of the present invention is to provide an improved fully automatic die casting machine of the above described type in which a finishing process of removing flash, an engageable portion, etc. from the article, a packing process of packing the articles in the box one box by one box and a recycling process of returning into a melting furnace, flash and the engageable portions which have been removed from the articles are performed in association with each other such that production efficiency of the fully automatic die casting machine is improved.

Still another object of the present invention is to provide an improved fully automatic die casting machine of the above described type in which an article supporting device is retractably provided between a fixed die and a movable die so as to be projected into between and retracted away from the fixed die and the movable die when the fixed die and the movable die are spaced away from each other and further, a coating device for coating die lubricant on recesses for defining cavities of the fixed die and the movable die is provided on the article supporting device such that a sufficient amount of the die lubricant is coated on the recesses.

A further object of the present invention is to provide an improved fully automatic die casting machine of the above described type in which the engageable portion is integrally formed with the article such that the article is positively retained by the article supporting device through fitting of the engageable portion into an opening of the article supporting device.

A still further object of the present invention is to provide an improved fully automatic die casting machine of the above described type which is simple in structure, highly reliable in actual use and suitable for mass production at low cost.

In accomplishing these and other objects according to one preferred embodiment of the present invention, there is provided an improved fully automatic die casting machine including a fixed die, a movable die, a melting furnace and an injection cylinder with at least either one of said fixed die and said movable die being provided with a first recess for defining a first cavity for forming an article and a second recess for defining a second cavity for forming an engageable portion on said article, in which molten metal contained in said melting furnace is injected into said first cavity and said second cavity by said injection cylinder so as to be cast into said article integrally formed with said engageable portion, said fully automatic die casting machine comprising: an article supporting device for supporting said article, which is retractably provided between said fixed die and said movable die and is formed with an opening for fixedly accommodating said engageable portion therein; a coating device for coating die lubricant on said first recess and said second recess, which is provided on said article supporting device; a finishing device for finishing said article integrally formed with said engageable portion into a finished article, which includes punch means so as to remove, by pressing said punch means onto said article supporting device, flash and said engageable portion from said article integrally formed with said engageable portion and supported by said article supporting device when said article supporting device has been retracted away from said fixed die and said movable die to a finishing position; a packing device including a plurality of boxes, which is arranged to pack a predetermined amount of said finished articles in said box one box by one box; and a recycling device for returning into said melting furnace the flash and said engageable portions which have been removed from said articles each integrally formed with said engageable portion.

In the fully automatic die casting machine according to the present invention, a required number for shots is set by a counter and a blue lamp is turned on before the number of the remaining shots reaches, for example, 20, an yellow lamp is turned on when number of the remaining shots reaches 20 and finally, a red lamp is turned on when the required number of shots have been performed.

In accordance with the present invention, operations of the fully automatic die casting machine are simplified greatly and production efficiency of the fully automatic die casting machine is improved remarkably.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
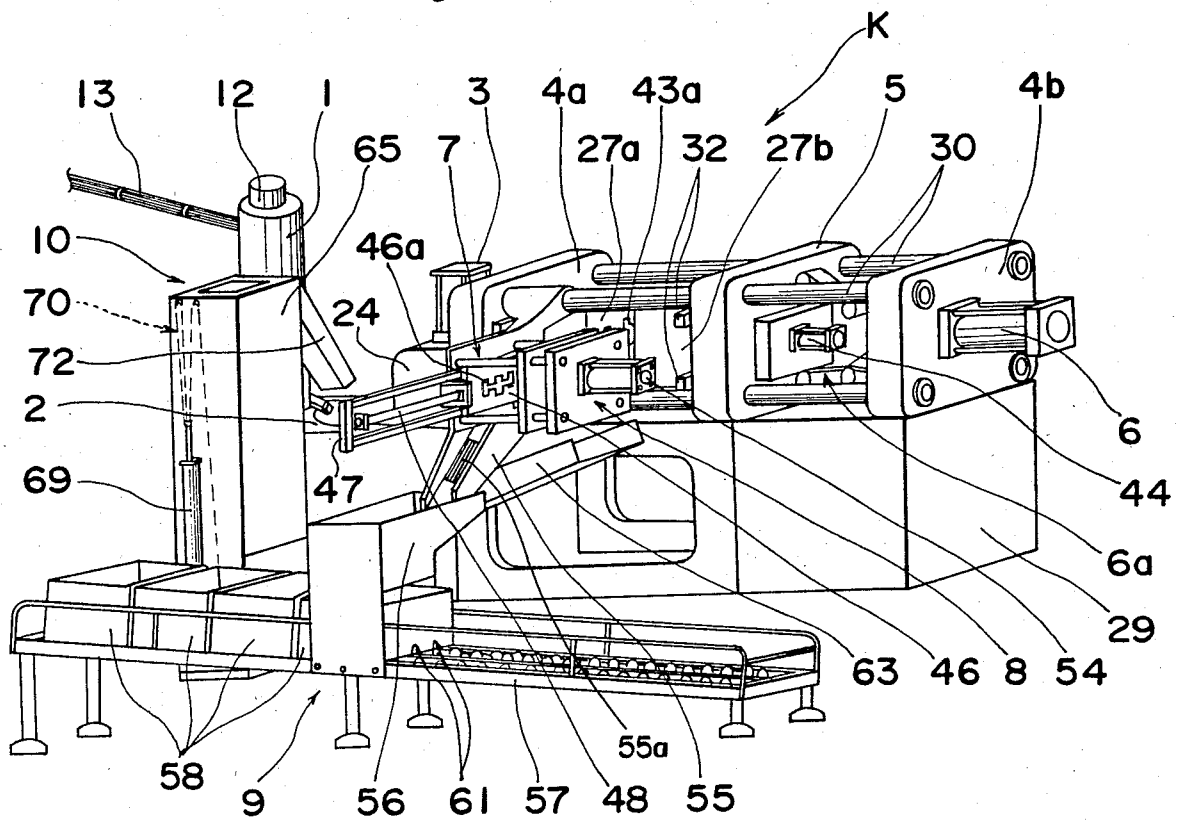
FIG. 1 is a perspective view of a fully automatic die casting machine according to one preferred embodiment of the present invention, FIG. 2 a top plan view of the fully automatic die casting machine of FIG. 1, with dies employed therein being clamped in position.

Referring now to the drawings, there is shown in FIGS. 1 to 15, a fully automatic die casting machine K according to one preferred embodiment of the present invention.

As shown in FIG. 1, the fully automatic die casting machine K generally includes a material feeding device 1, a melting furnace 2, an injection cylinder 3, a pair of fixed frames 4*a* and 4*b*, a movable frame 5, a cylinder 6 for driving the movable frame 5, an article supporting device 7, a finishing device 8, a packing device 9, a recycling device 10 and a base 29. The cylinder 6 is provided with a toggle mechanism 6*a*. The fixed frames 4*a* and 4*b* are fixedly mounted on a front end portion and a rear end portion of the base 29, while the movable frame 5 is movably provided between the fixed frames 4*a* and 4*b* so as to be guided by four tie-bars 30 extending between the fixed frames 4*a* and 4*b* such that the movable frame 5 is displaced in forward and backward directions of the base 29.

Figure 2:
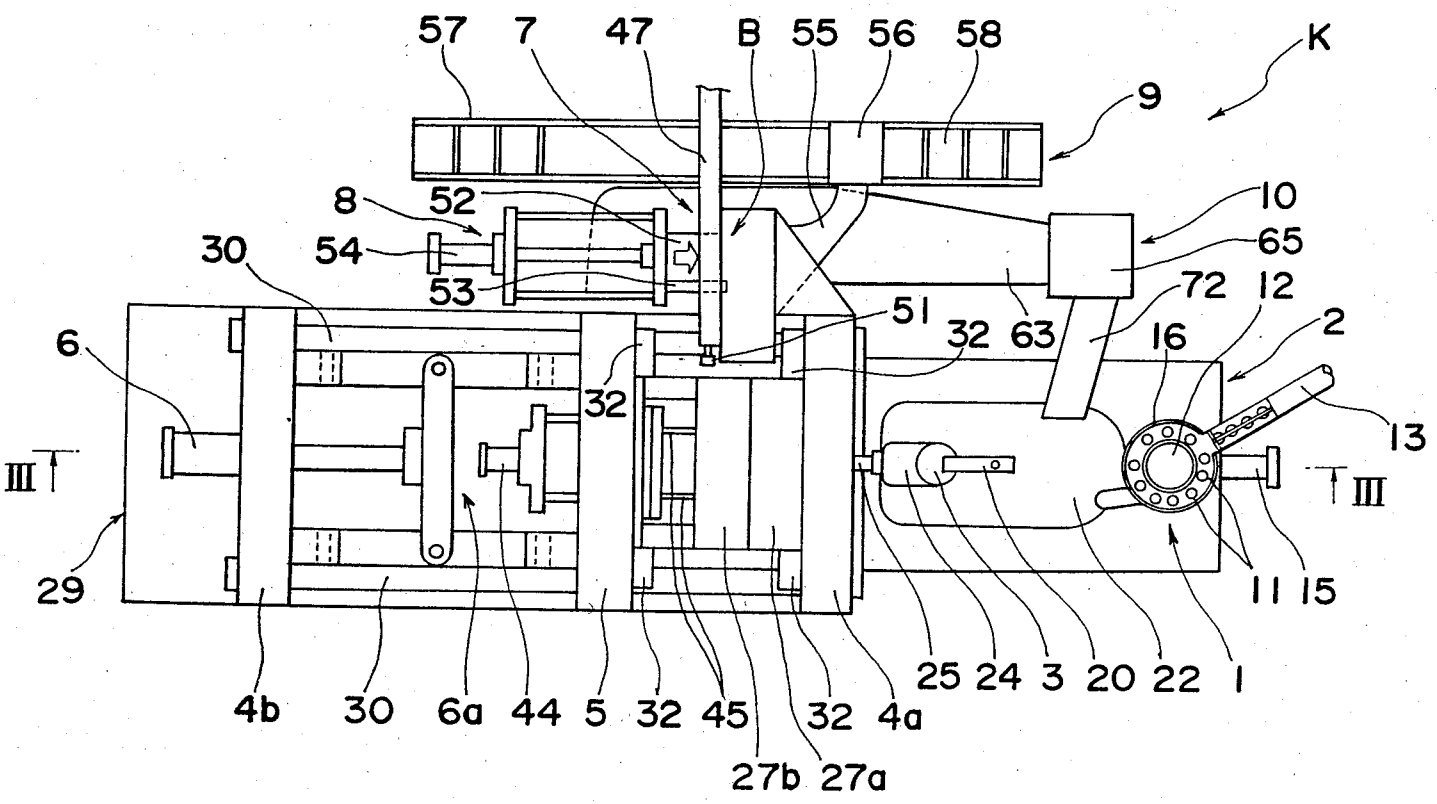
Figure 3:
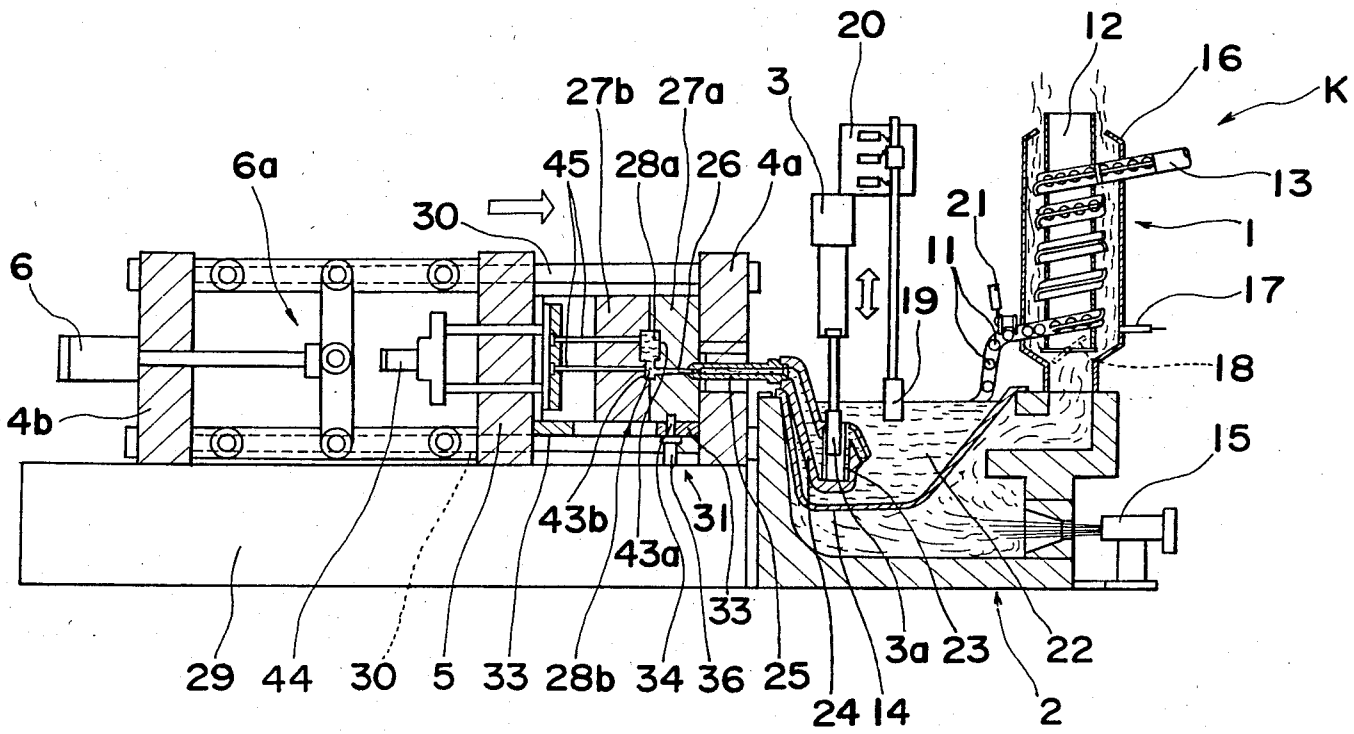
FIG. 3 is a cross-sectional view taken along the line III—III in FIG. 2.

Referring to FIGS. 2 and 3, the material feeding device 1 includes a chimney 12, a feed chute 13 helically wound around an outer periphery of the chimney 12, a hood 16 surrounding the chimney 12, a thermal sensor 17 and a control damper 18. Thus, spherical ingots 11 are fed into a melting pot 14 of the melting furnace 2 by the feed chute 13. Furthermore, exhaust gas discharged from a burner 15 for heating the melting furnace 2 is introduced between the hood 16 and the chimney 12 such that the spherical ingots 11 are preheated in the hood 16 through temperature control of the exhaust gas of the burner 15, which temperature control is effected by the control damper 18 associated with the thermal sensor 17.

It is to be noted that molten metal 22 contained in the melting pot 14 of the melting furnace 2 is arranged to be maintained at a predetermined level by a level sensor 20 provided with a float 19. Accordingly, it is so arranged that, when level of the molten metal 22 drops below the predetermined level, the spherical ingots 11 are fed into the melting furnace 2 by opening an inlet of the feed chute 13 through a cylinder 21 such that level of the molten metal 22 is raised.

It is so arranged that the molten metal 22 is injected from a sleeve 23 into a first cavity 28*a* and a second cavity 28*b* through a gooseneck 24, a nozzle 25 and a sprue 26 in response to descent of a piston rod 3*a* of the injection cylinder 3, with the first cavity 28*a* and the second cavity 28*b* to be described later being formed on a pair of a fixed die 27*a* and a movable die 27*b*. The fixed die 27*a* is mounted on the fixed frame 4*a* provided at the front end portion of the base 29, while the movable die 27*b* is mounted on the movable frame 5 so as to be movably supported by the tie-bars 30.

Figure 4:
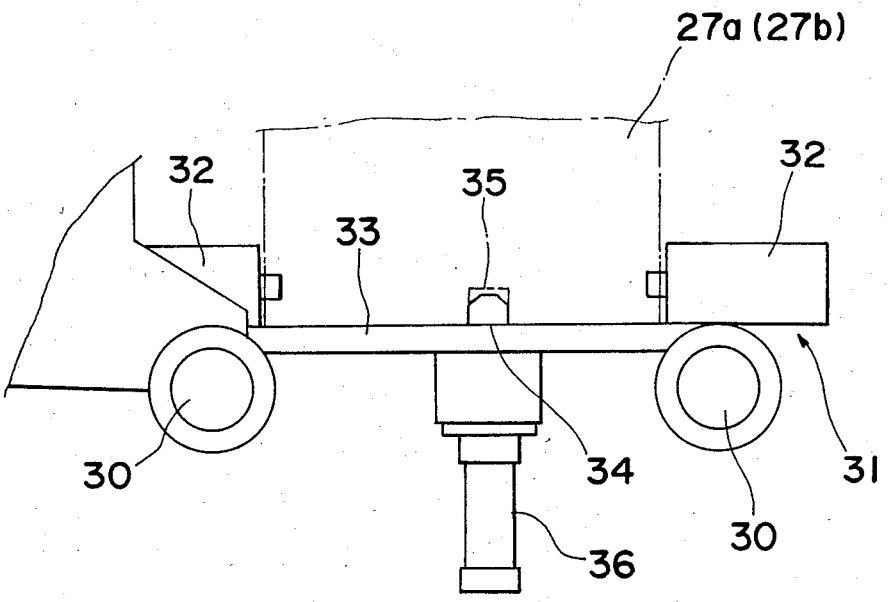
FIG. 4 is a view explanatory of a die positioning device employed in the full automatic die casing machine of FIG. 1.
Figure 5:
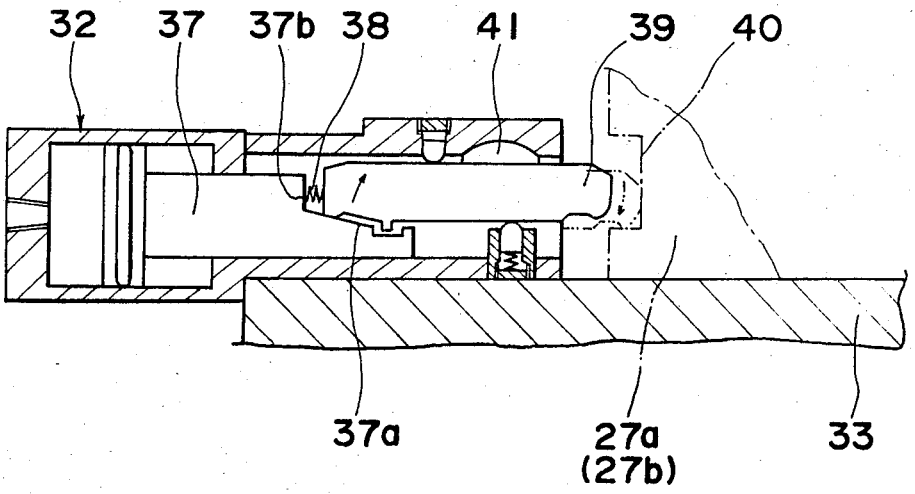
FIG. 5 is a cross-sectional view of a die clamping device employed in the full automatic die casting machine of FIG. 1.

The fixed die 27*a* and the movable die 27*b* are mounted on the fixed frame 4*a* and the movable frame 5, respectively by die clamping devices 32 provided at opposite sides of the fixed die 27*a* and the movable die 27*b* after each of the fixed die 27*a* and the movable die 27*b* has been positioned by a die positioning device 31. More specifically, initially, the fixed die 27*a* and the movable die 27*b* are placed on a die mounting plate 33 by the use of a crane. Then, as shown in FIG. 4, a tapered pin 33 coupled with a hydraulic cylinder 36 is driven, by the hydraulic cylinder 36, from an underside of the die mounting plate 33 into a tapered slot 35 formed on each of the fixed die 27*a* and movable die 27*b* and thus, the fixed die 27*a* and the movable die 27*b* are positioned at predetermined positions. After the fixed die 27*a* and the movable die 27*b* have been positioned at the predetermined positions as described above, a piston rod 37 having an inclined face 37*a* formed at a front portion thereof is driven such that an arm 39 is displaced in a direction toward each of the fixed die 27*a* and the movable die 27*b* by an urging force of a spring 38 provided between the arm 39 and a front end face 37*b* of the piston rod 37 as shown in FIG. 5, so that a front end of the arm 39 is brought into pressure contact with a recessed portion 40 formed on each of the opposite sides of each of the fixed die 27*a* and the movable die 27*b*. Thereafter, the piston rod 37 is further driven in the direction toward each of the fixed die 27*a* and the movable die 27*b* such that the spring 38 is compressed, so that a rear end of the arm 39 is lifted upwardly along the inclined face 37*a* of the piston rod 37 and thus, a front end of the arm 39 is pivoted downwardly about a fulcrum 41, whereby the fixed die 27*a* and the movable die 27*b* are clamped to the die mounting plate 33.

Meanwhile, a first recess 43*a* and a second recess 43*b* are provided on each of mating faces of the fixed die 27*a* and the movable die 27*b* such that the first recesses 43*a* and the second recesses 43*b* define the first cavity 28*a* for forming an article 42 and the second cavity 28*b* for forming an engageable portion 42*a* having a shape of circular truncated cone, respectively when the fixed die 27*a* and the movable die 27*b* are clamped in position, whereby the engageable portion 42*a* is integrally cast with the article 42.

Figure 6:
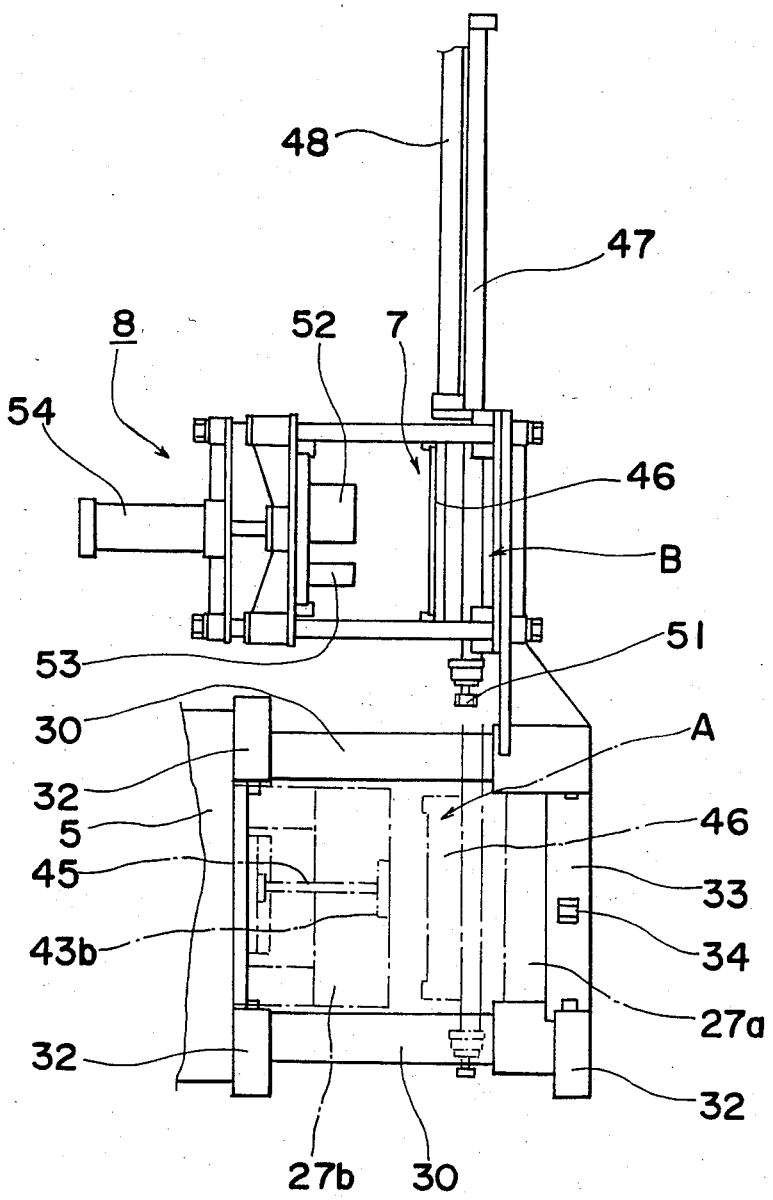
FIG. 6 is a top plan view of an article supporting device and a finishing device both employed in the fully automatic die casting machine of FIG. 1, FIGS. 7(*a*) to 7(*c*) are fragmentary cross-sectional views explanatory of accommodation of an engageable portion integrally formed with an article into an opening of the article supporting device of FIG. 6, FIG. 7(*d*) is a fragmentary cross-sectional view explanatory of removal of the engageable portion from the article by the finishing device of FIG. 6.
Figure 7A:
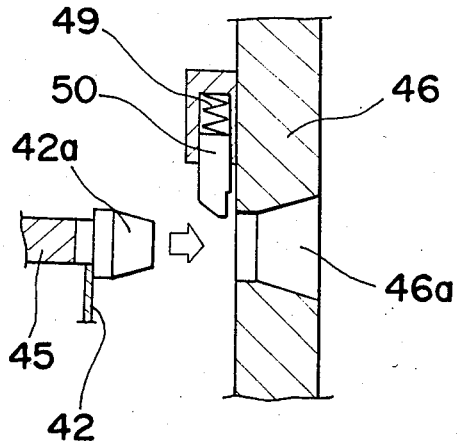
Figure 7B:
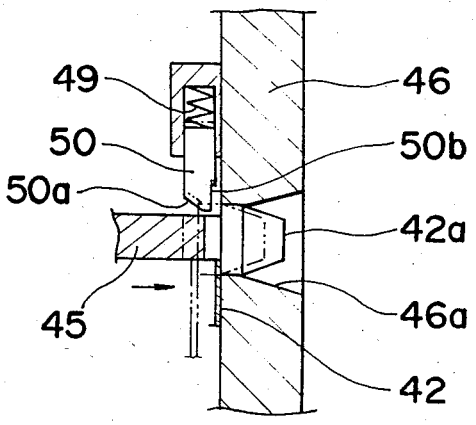
Figure 7C:
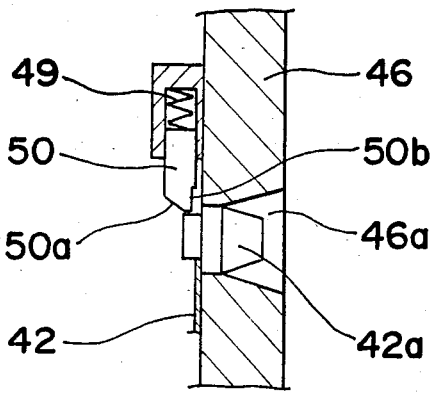
Figure 7D:
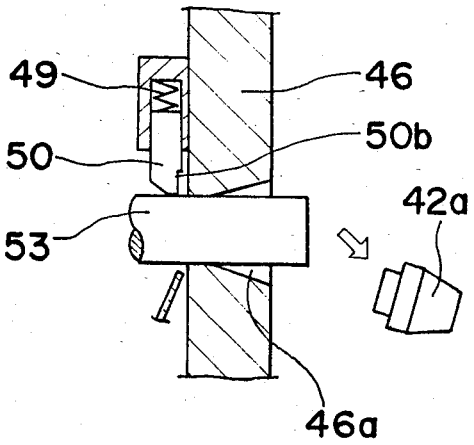
Figure 8:
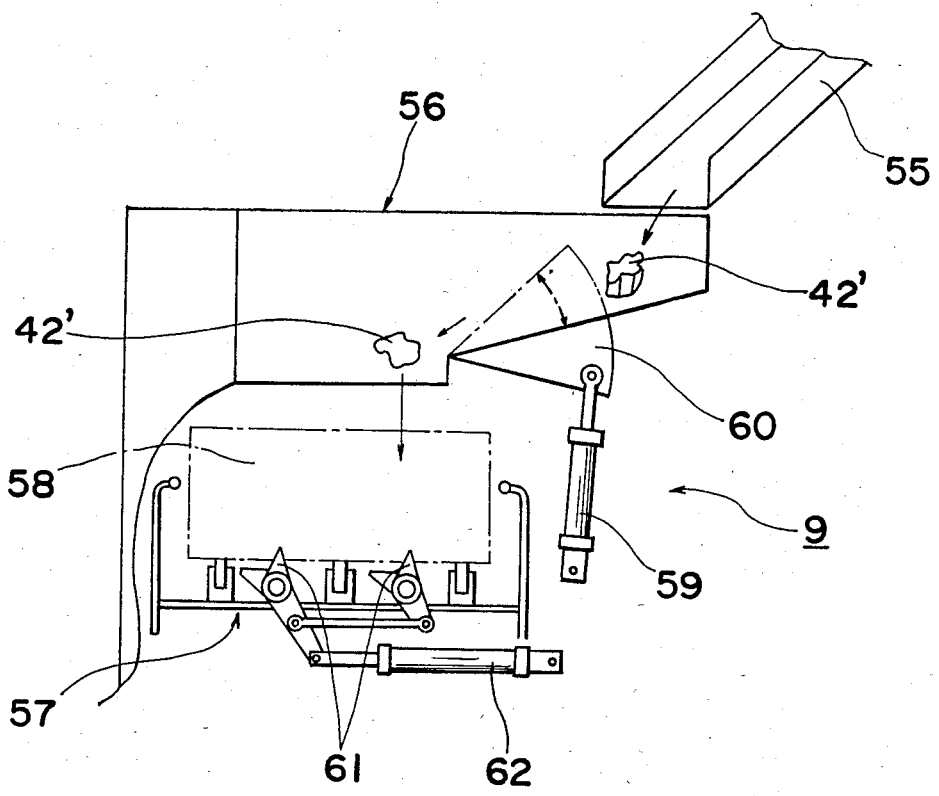
FIG. 8 is a front elevational view of a packing device employed in the fully automatic die casting machine of FIG. 1, FIGS. 9(*a*) and 9(*b*) are a front elevational view and a side elevational view of a recycling device employed in the fully automatic die casting device of FIG. 1, respectively.

It is so arranged that the article 42 is ejected out of the movable die 27*b* by a pair of ejector pins 45 driven by an ejector cylinder 44 so as to be supported by the article supporting device 7 disposed at the article supporting position A shown in FIG. 6. As shown in FIG. 6, the article supporting device 7 includes a trimming die 46 formed with an opening 46*a* for accommodating the engageable portion 42*a* therein and another opening (not shown) for accommodating the cast article 42, a trimming arm 47 and a driving cylinder 48. The trimming die 46 and the trimming arm 47 are driven in a horizontal direction of the fully automatic die casting machine K by the driving cylinder 48 so as to be projected into between or retracted away from the fixed die 27*a* and the movable die 27*b* when the fixed die 27*a* and the movable die 27*b* are spaced away from each other. It is so arranged that the unfinished article 42 and engageable portion 42*a* attached to the movable die 27*b* is fixedly secured in the trimming die 46 by the engageable portion 42*a* being fit into opening 46*a* when the trimming die 46 has been projected into between the fixed die 27*a* and the movable die 27*b*.

As best shown in FIGS. 7(*a*) to 7(*d*), the engageable portion 42*a* of the article 42 is formed into a shape of circular truncated cone whose reduced diameter portion confronts the fixed die 27*a* while the opening 46*a* for accommodating the article 42 and the engageable portion 42*a* therein is formed into a conical shape whose reduced diameter portion is disposed at a side of the trimming die 46 adjacent to the movable die 27*b*. The article supporting device 7 of the fully automatic die casting machine K further includes a spring 49 and a pawl 50 having an inclined face 50*a* and a claw portion 50*b* such that the pawl 50 provided adjacent to the opening 46*a* is urged in a radial direction of the opening 46*a* by the spring 49. When the engageable portion 42*a* is fitted into the opening 46*a* as shown in FIG. 7(*a*), the engageable portion 42*a* is guided into the opening 46*a* by the inclined face 50*a* of the pawl 50 as shown in FIG. 7(*b*) and, at the same time, an end face of the engageable portion 42*a* fitted into the opening 46*a* is retained by the claw portion 50*b* of the pawl 50 as shown in FIG. 7(*c*), with the end face of the engageable portion 42*a* being disposed at a side of the trimming die 46 adjacent to the movable die 27*b*. Thus, the article 42 is retained in the opening 46*a*.

Furthermore, the fully automatic die casting machine K includes a plurality of nozzles 51 acting as a coating device for coating die lubricant. It is so arranged that a sufficient amount of the die lubricant is coated, through time control, on the first recess 43*a* and the second recess 43*b* formed on each of the fixed die 27*a* and the movable die 27*b* when the trimming die 46 having the article 42 supported therein is being retracted away from the fixed die 27*a* and the movable die 27*b*. Subsequently, it is so arranged that the article 42 supported by the trimming die 46 is finished at the finishing position B shown in FIGS. 2 and 6 by the finishing device 8.

The finishing device 8 includes an ejector punch 52 for ejecting the article 42 through and out of the trimming die 46, a punch 53 for ejecting the engageable portion through and out of opening 46*a* to thus remove the engageable portion 42*a* from the article 42, and a cylinder 54 for driving the ejector punch 52 and the punch 53 as shown in FIG. 6. The ejector punch 52 and the punch 53 are driven as one unit by the cylinder 54 so as to be pressed onto the trimming die 46 disposed at the finishing position B such that the engageable portion 42*a* and flash formed during casting are removed from the article 42 as shown in FIG. 7(*d*), whereby the article 42 integrally formed with the engageable portion 42*a* is finished into a finished article 42'. The finished article 42' passes down a chute 55 having appropriate openings such as betwee rails 55*a* as shown in FIG. 1 for transmitting the separated engageable portion 42*a* that falls onto the chute 63 that is carrying the flashing.

Subsequently, the finished articles 42' which have been obtained as described above are packed, through a chute 55 and a hopper 56, in a box 58 temporarily stopped on a conveyor 57. In the hopper 56, a stopper 60 is actuated in response to passing of a predetermined number of the finished articles 42' by a cylinder 59 so as to prevent the finished article 42' from being packed in the box 58 temporarily. Thereafter, a pair of stoppers 61 of the conveyor 57 are disengaged from the box 58 such that the box 58 filled with the finished articles 42' is conveyed by the conveyor 57 and, at the same time, a next empty box 58 is stopped at a predetermined position by the stoppers 61 such that packing of the finished articles 42' in the box 58 can be resumed.

Figure 9:
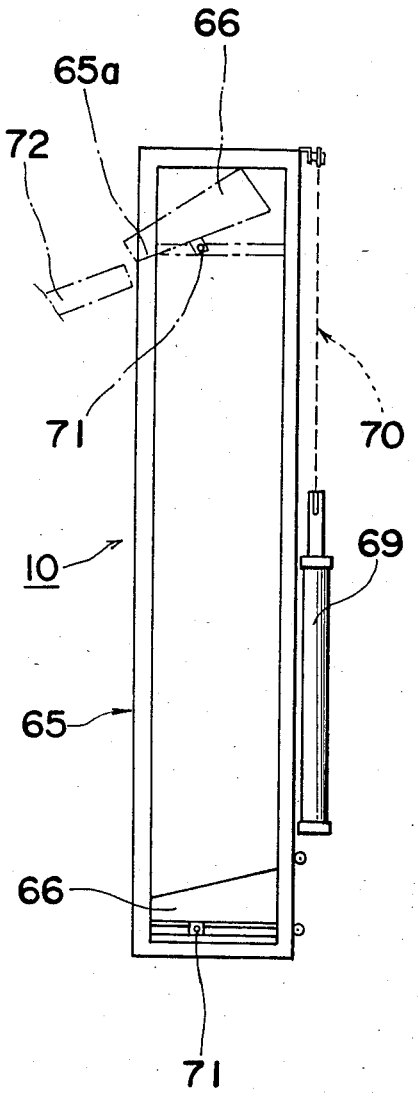
Figure 9:
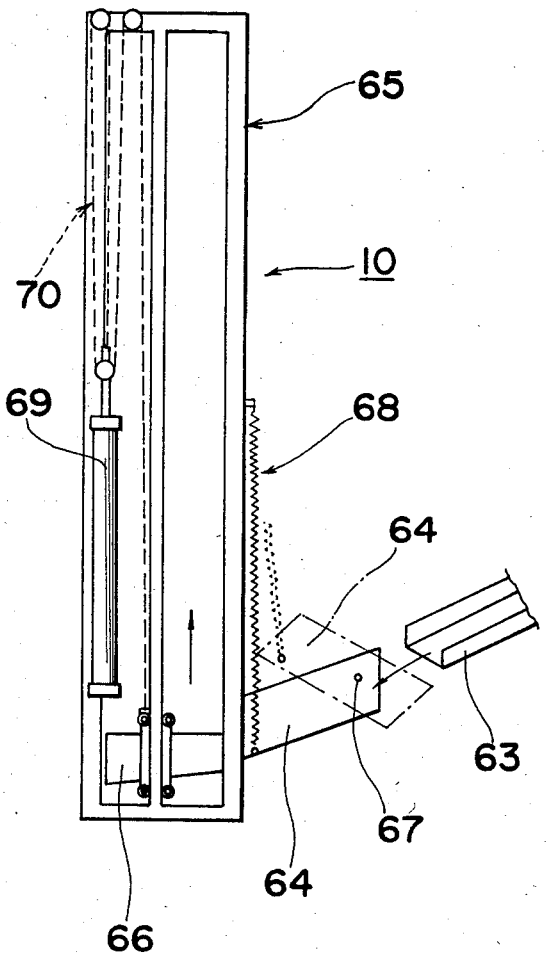

Moreover, as shown in FIGS. 9(*a*) and 9(*b*), the recycling device 10 includes chutes 63, 64 and 72, an elevator 65 formed with a cutout 65*a*, a bucket 66, a spring 68, a cylinder 69 and a chain 70. The flash and the engageable portions 42*a* which have been removed from the articles 42 are carried into the bucket 66 in the elevator 65 through the chutes 63 and 64. When a predetermined amount of the flash and the engageable portions 42 have been carried into the bucket 66, the chute 64 is tilted about a fulcrum 67 with the aid of spring 68 so as to prevent the flash and the engageable portions 42*a* from being further carried into the bucket 66. Subsequently, the bucket 66 loaded with the flash and the engageable portions 42*a* is moved upwardly in the elevator 65 by the cylinder 69 through the chain 70. Then, when the bucket 66 reaches an upper limit position of its travel stroke, the bucket 66 is tilted about a fulcrum 71 such that the flash and the engageable portions 42*a* are carried into the melting furnace 2 through the cutout 65*a* of the elevator 65 and the chute 72.

Hereinbelow, operations of the full automatic die casting machine K will be described.

Initially, as shown in FIGS. 2 and 3, the fixed die 27*a* and the movable die 27*b* are clamped in position so as to form the first cavity 28*a* and the second cavity 28*b* therebetween and then, the molten metal 22 is injected into the first cavity 28*a* and the second cavity 28*b* by the injection cylinder 3 so as to be cast into the article 42 integrally formed with the engageable portion 42*a*.

Figure 10:
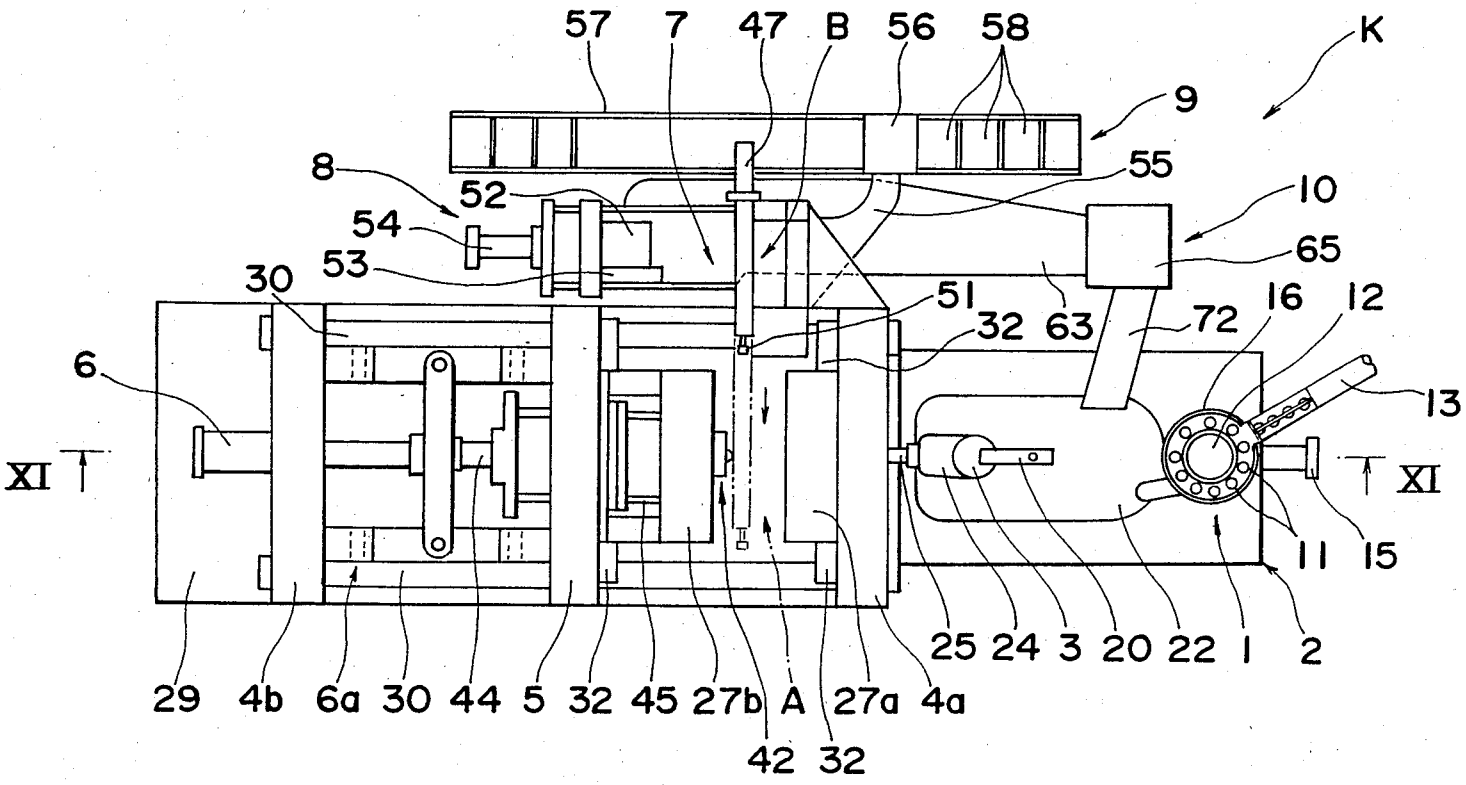
FIG. 10 is a view similar to FIG. 2, particularly showing the dies separated away from each other, FIG. 11 a cross-sectional view taken along the line XI—XI in FIG. 10.
Figure 11:
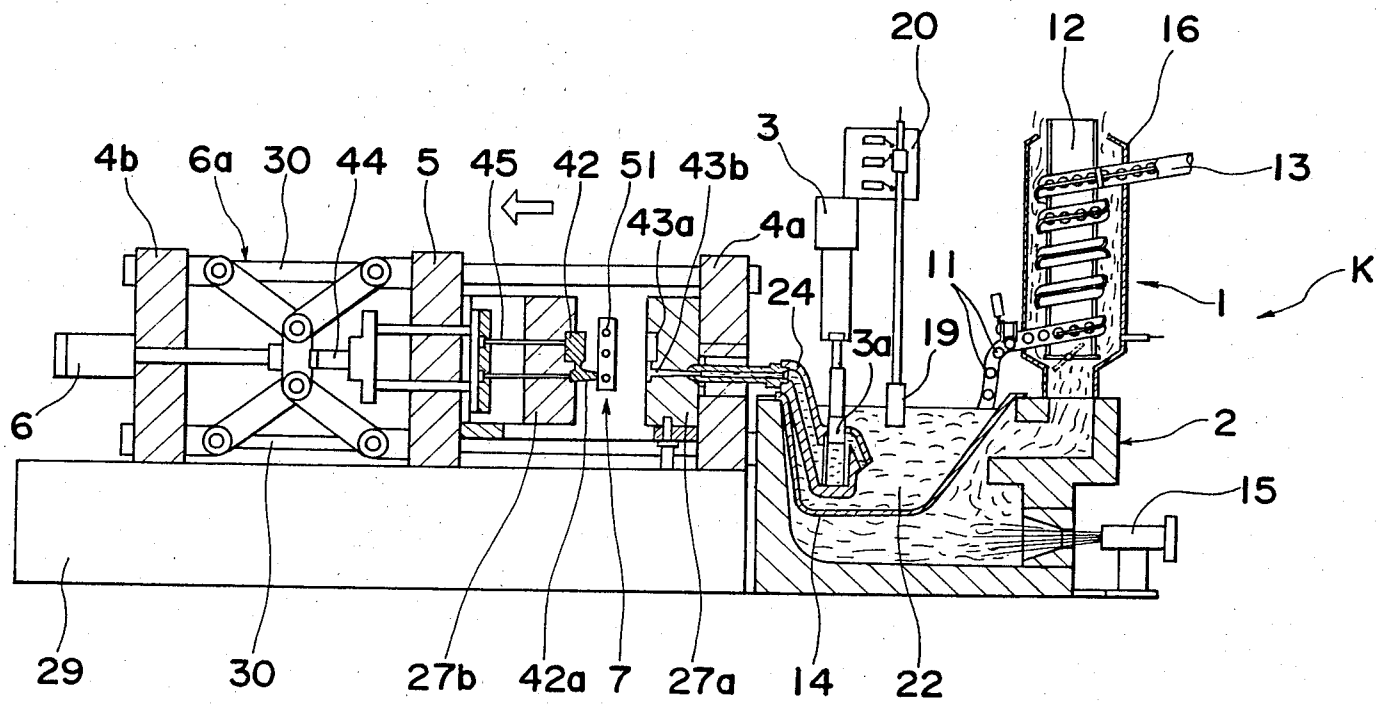

Subsequently, as shown in FIGS. 10 and 11, after the fixed die 27*a* and the movable die 27*b* have been released away from each other with the article 42 integrally formed with the engageable portion 42*a* being attached to the movable die 27b, the trimming die 46 is projected into between the fixed die 27a and the movable die 27b.

Figure 12:
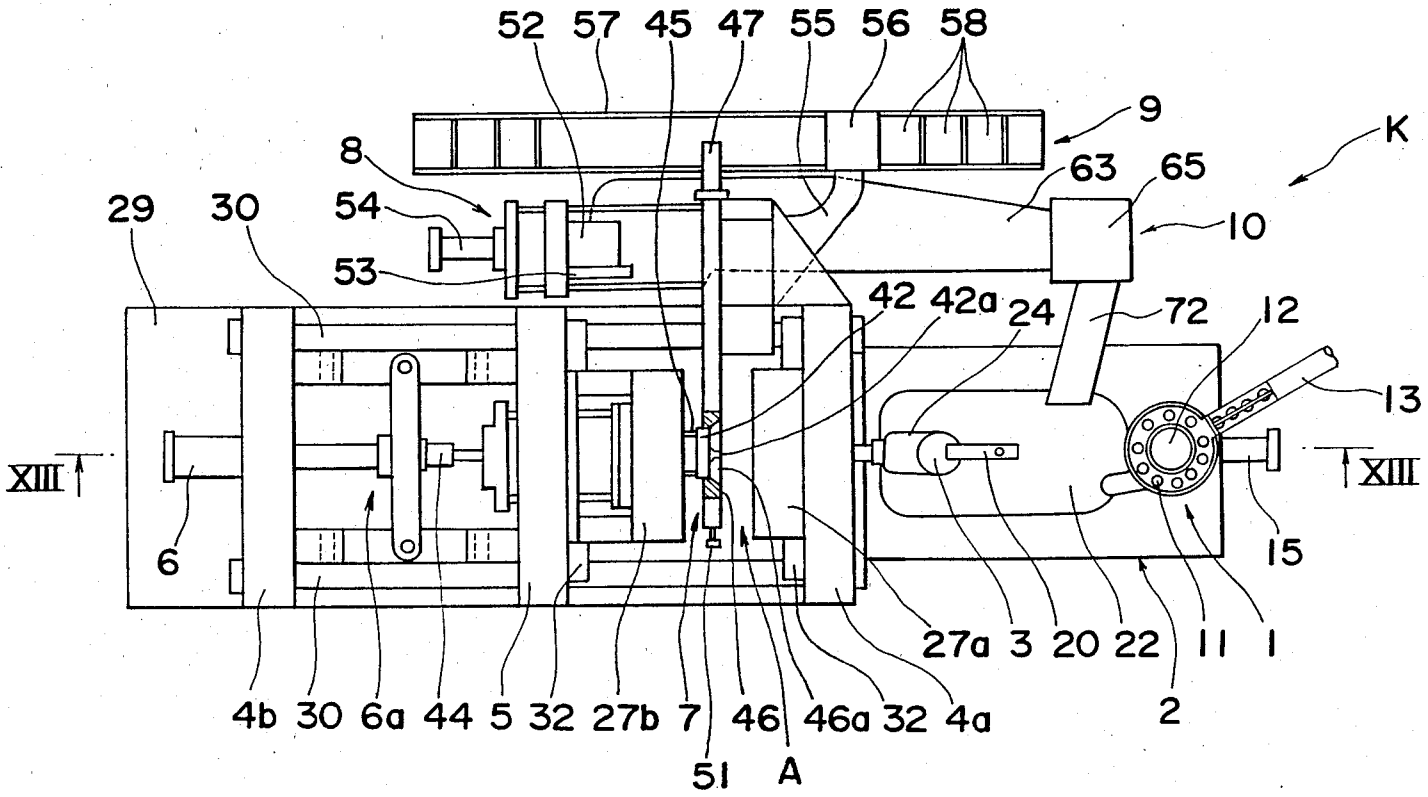
FIG. 12 is a view similar to FIG. 10, particularly showing the article supported by the article supporting device of FIG. 6.
Figure 13:
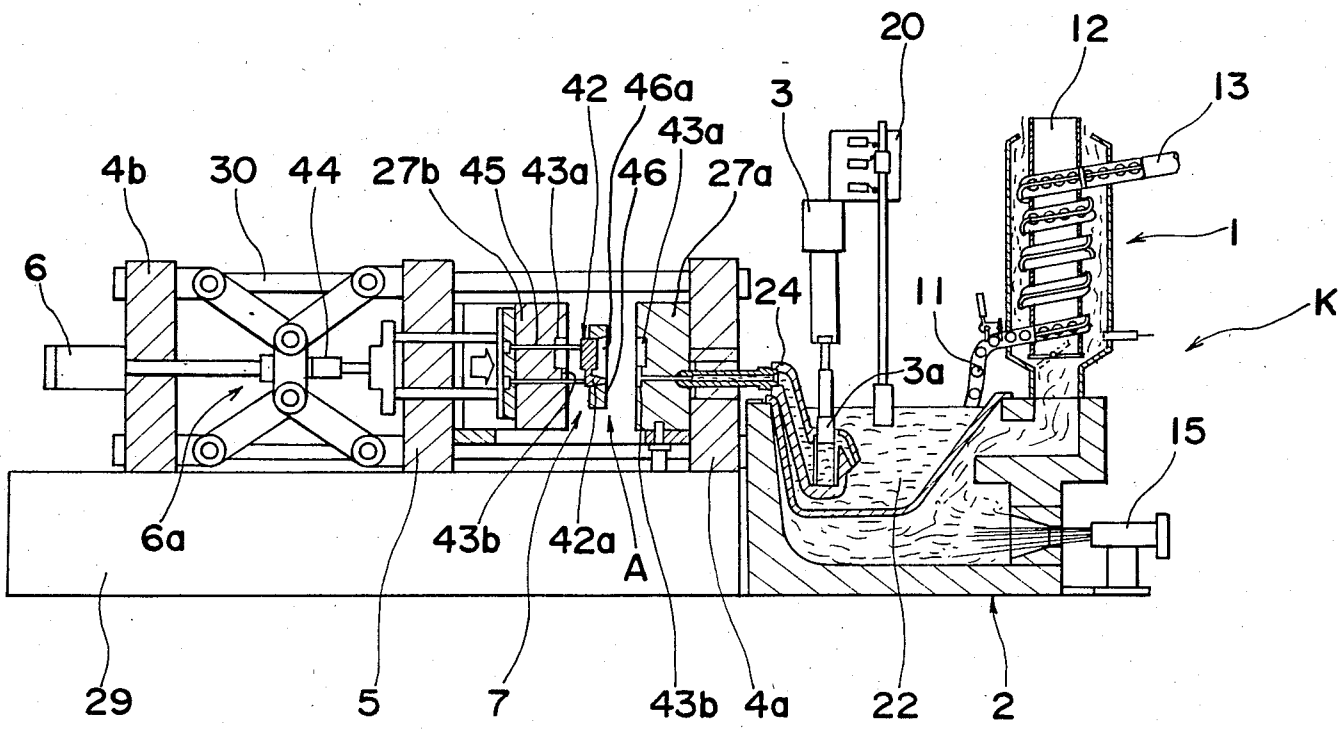
FIG. 13 is a cross-sectional view taken along the line XIII—XIII in FIG. 12.

Thereafter, as shown in FIGS. 12 and 13, the article 42 integrally formed with the engageable portion 42a is ejected out of the movable die 27b so as to be fixedly fitted into the opening 46a of the trimming die 46.

Figure 14:
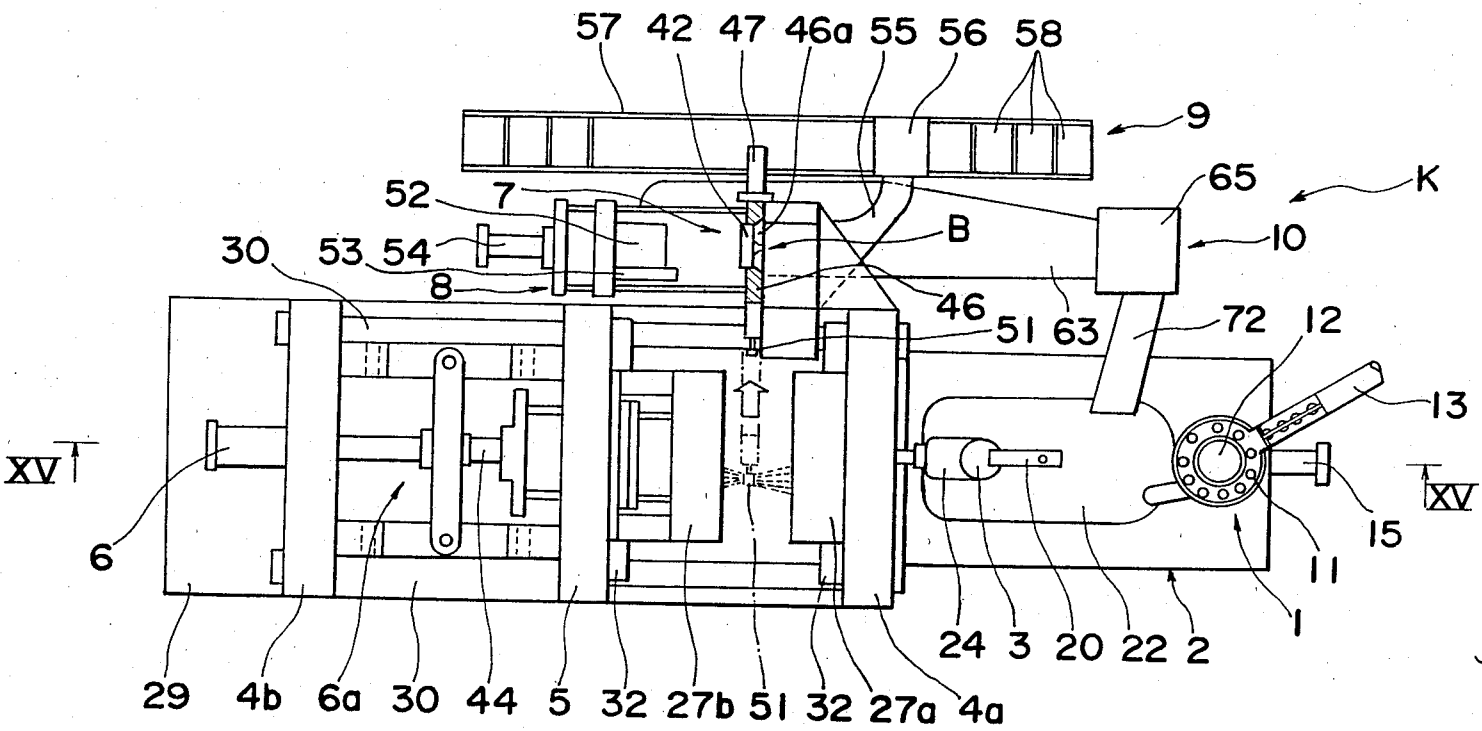
FIG. 14 is a view similar to FIG. 12, particularly showing the article supporting device of FIG. 6 retracted away from the dies.
Figure 15:
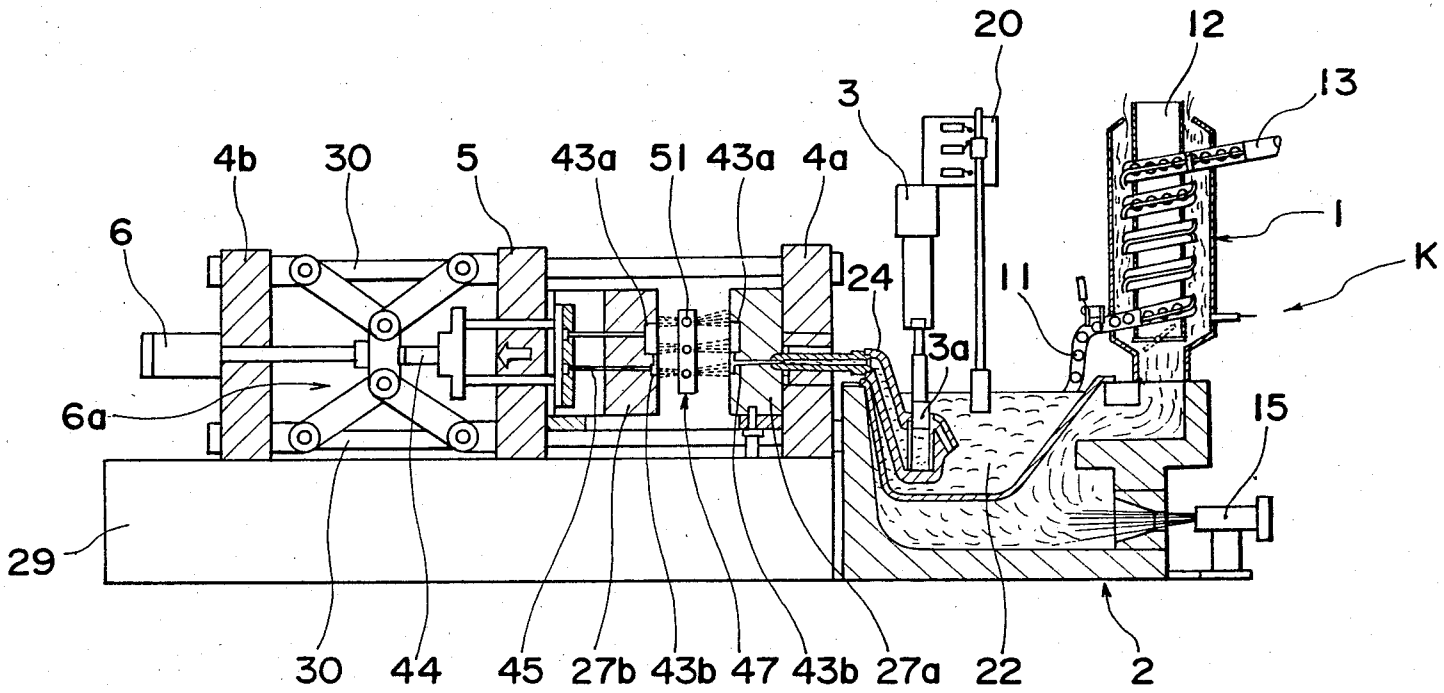
FIG. 15 is a cross-sectional view taken along the line XV—XV in FIG. 14.

Then, as shown in FIGS. 14 and 15, the die lubricant is coated on the first recess 43a and the second recess 43b formed on each of the fixed die 27a and the movable die 27b by the nozzles 51 when the trimming die 46 is being retracted away from the fixed die 27a and the movable die 27b.

Subsequently, as shown in FIGS. 2 and 3, the fixed die 27a and the movable die 27b are clamped in position such that a next cycle of operations of die casting can be performed.

Meanwhile, the ejector punch 52 and the punch 53 are pressed onto the trimming die 46 supporting the article 42 integrally formed with the engageable portion 42a as shown in FIG. 2, so that the engageable portion 42a and the flash are removed from the article 42 and thus, the article 42 is finished into the finished article 42'. Then, a predetermined amount of the finished articles 42' ejected out of the trimming die 46 by the ejector punch 52 are packed in the box 58 on the conveyor 57 one box by one box through the chute 55 and the hopper 56. At the same time, the flash and the engageable portions 42a which have been removed from the articles 42 are temporarily collected in the bucket 66 through the chutes 63 and 64 and then, are carried into the melting furnace 2 from the chute 72 after the bucket 66 loaded with the flash and the engageable portions 42a has been lifted above the melting furnace 2 by the elevator 65.

In the fully automatic die casting machine K, since the spherical ingots 11 are used as the casting material, feeding of the casting material into the molting furnace 2 can be remarkably smoothly performed. Furthermore, since it is so arranged that the spherical ingots 11 are preheated by utilizing heat of the exhaust gas which has been used for heating the melting furnace 2, thermal efficiency of the full automatic die casting machine K has been greatly improved. Meanwhile, conventionally, it has been so arranged that the fixed die 27a and the movable die 27b are positioned by clamping or unclamping the fixed die 27a and the movable die 27b repeatedly, which is a time-consuming operation requiring an operator's skill. However, in the fully automatic die casting machine K, the fixed die 27a and the movable die 27b are positioned easily and positively by using the hydraulic cylinders 36.

Furthermore, conventionally, it has been so arranged that the fixed die 27a and the movable die 27b are clamped in position by fastening a bolt of each of vises provided at several locations, which is a troublesome operation. On the other hand, in the fully automatic die casting machine K, the fixed die 27a and the movable die 27b can be clamped in position by simultaneously clamping several locations of each of the fixed die 27a and the movable die 27b through synchronous drive of the piston rod 37. Moreover, since the engageable portion 42a and the pawl 50 are provided in the fully automatic die casting machine K, the article 42 can be retained in the trimming die 46 smoothly and positively. At the same time, since the engageable portion 42a is retained by the pawl 50, the article 42 can be prevented from being disengaged from the opening 46a of the trimming die 46 even if the ejector pin 45 is retracted away from the trimming die 46. Furthermore, the engageable portion 42a can be used for preventing overflow of the molten metal 22 injected into the fixed die 27a and the movable die 27b or venting gas from the injected molten metal.

Meanwhile, in the fully automatic die casting machine K, a sufficient amount of the die lubricant can be uniformly coated on the first recess 43a and the second recess 43b formed on each of the fixed die 27a and the movable die 27b at any injection angle by changing directions of the nozzles 51.

Furthermore, in the fully automatic die casting machine K, since the engageable portions 42a and the flash which have been removed from the articles 42 are rapidly carried into the bucket 66 so as to be returned into the melting furnace 2, thermal efficiency of the fully automatic die casting machine K has been remarkably improved.

Figure 16:
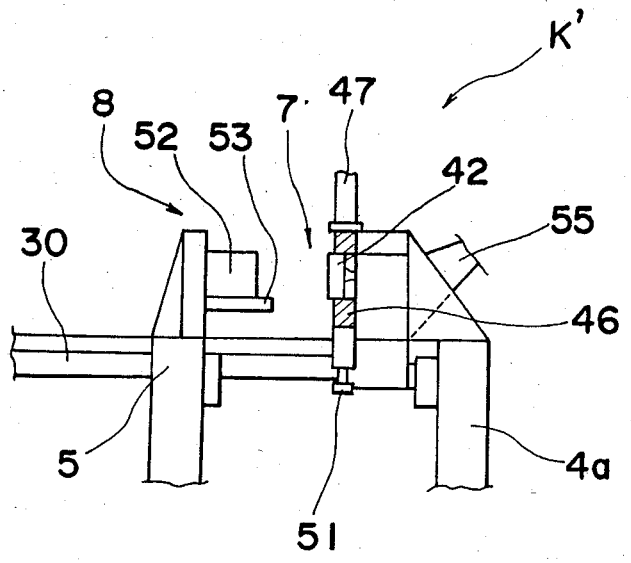
FIG. 16 is a fragmentary top plan view explanatory of a modification of the fully automatic die casting device of FIG. 1.

Referring now to FIG. 16, there is shown a modification of the fully automatic die casting machine K. In the modified fully automatic die casting machine K', since the fixed die 27a and the movable die 27b are clamped in position synchronously with finishing of the article 42 by mounting the ejector punch 52 and the punch 53 on the movable frame 5 it becomes unnecessary to provide a driving device for driving the ejector punch 52 and the punch 53.

It should be noted that the fully automatic die casting machine according to the present invention can be applied to trimming of synthetic resin. In the fully automatic die casting machine according to the present invention, a required number for shots is set by a counter and a blue lamp is turned on before the number of the remaining shots reaches, for example, 20, a yellow lamp is turned on when number of the remaining shots reaches 20 and finally, a red lamp is turned on when the required number of shots have been performed such that all the processes of the fully automatic die casting machine are efficiently associated with each other for fully automatic operations.

As is clear from the foregoing description, since operations of the fully automatic die casting machine are simplified with consequent reduction of the operations, one operator can operate 6 to 10 fully automatic die casting machines at a time although conventionally one operator could operate 1 to 2 die casting machines at most at a time.

Furthermore, in accordance with the present invention, since the process of removing the flash and the engageable portion from the article, the process of packing the articles in the box, and the process of returning the flash and the engageable portions into the melting furnace are performed in association with each other, production efficiency of the fully automatic die casting machine is remarkable improved and further, waste materials such as the flash and the engageable portions can be effectively reused.

Moreover, in accordance with the present invention, since the coating device for coating the die lubricant is provided on the article supporting device so as to be projected into between and retracted away from the fixed die and the movable die, a sufficient amount of the die lubricant can be coated on the recesses formed on the fixed die and movable die.

In addition, in accordance with the present invention, since the engageable portion is integrally formed with the article so as to be fixedly fitted into the opening of the article supporting device, the article is supported by the article supporting device easily and positively.

Although the present invention has been fully described by way of example with reference to the accompanying drawings, it is to be noted here that various changes and modifications will be apparent to those skilled in the art. Therefore, unless otherwise such changes and modifications depart from the present invention, they should be construed as included therein.

What is claimed is:

1. A fully automatic die casting machine comprising:

a fixed die;

a movable die, at least one of said fixed and movable dies being provided with a first recess for defining a first cavity for forming an article and a second recess defining a second cavity for forming an engageable portion on said article, the engageable portion having a cylindrical section adjacent the article and a truncated cone section of decreasing diameter extending outwardly from said cylindrical section, the engageable portion further defining an end face adjacent the cylindrical section;

a melting furnace;

an injection cylinder, the injection cylinder being arranged to inject molten metal from said melting furnace into said first and second cavities so as to be cast into said article and said engageable portion as an integral unit;

an article supporting device for supporting said article which is retractably provided between said fixed die and movable dies and is formed with a first circular opening of a predetermined dimension to receive and secure the cylindrical section of the engageable portion therein, the article supporting device including pawl means arranged to permit the engageable portion to enter said first opening in one direction and to extend over a part of the end face of the engageable portion to prevent said engageable portion from exiting said first opening in a direction opposite to said one direction;

a finishing device for finishing said article integrally formed with said engageable portion into a finished article which includes punch means so as to remove, by pressing said punch means onto said article supporting device in said one direction, said flash and said engageable portion from said article integrally formed with said engageable portion and supported by said article supporting device when said article supporting device has been retracted away from said fixed die and said movable die to a finishing position; and a recycling device for returning to said melting furnace the flash and said engageable portions which have been removed from said articles that have been formed integrally with said engageable portion.

2. A fully automatic die casting machine as claimed in claim 1 wherein said pawl means includes a pawl carried on one side of said article supporting device and a spring for biasing the pawl to an initial position closing a portion of first opening, said pawl member having an inclined face for engaging the truncated and cylindrical sections of the engageable portion, whereby the pawl is moved outwardly from said initial position as the engageable portion is inserted into the first opening and is returned to its initial position when the cylindrical section of the engageable portion is completely inserted into said first opening to thereby secure the engageable portion within said first opening.

3. A fully automatic die casting machine as claimed in claim 1 further including a packing device including a plurality of boxes, which are arranged to pack a predetermined amount of said finished articles in said box, one box by one box.

4. A fully automatic die casting machine as claimed in claim 3, further including a coating device for coating die lubricant on said first recess and said second recess, which is provided on said article supporting device.

5. A fully automatic die coating machine as claimed in claim 4, further including a die clamping device for clamping said fixed die and said movable die in position.

6. A fully automatic die casting machine as claimed in claim 5, further including a material feeding device for feeding casting material in the form of spherical ingots into said melting furnace, said material feeding device comprising a feed chute wound in a helical configuration.

7. A fully automatic die casting machine as claimed in claim 1, wherein said article supporting device comprises a die formed with said first opening and a second opening for fixedly accomodating said article therein and a driving device for driving said die, said finishing device further including a driving member for driving said punch means, said punch means including an ejector punch for ejecting said article from said article supporting device and a punch for removing said engageable portion from said article.

8. A fully automatic die casting machine as claimed in claim 4, wherein said article supporting device comprises a die formed with said first opening and a second opening for fixedly accomodating said article therein and a driving device for driving said die, said finishing device further including a driving member for driving said punch means, said punch means including an ejector punch for ejecting said article from said article supporting device and a punch for removing said engageable portion from said article.

9. A fully automatic die casting machine as claimed in claim 6, wherein said article supporting device comprises a die formed with said first opening and a second opening for fixedly accomodating said article therein and a driving device for driving said die, said finishing device further including a driving member for driving said punch means, said punch means including an ejector punch for ejecting said article from said article supporting device and a punch for removing said engageable portion from said article.

10. A fully automatic die casting machine as claimed in claim 3, wherein said packing device comprises a chute, a hopper and a conveyor for transporting the plurality of said boxes such that the predetermined amount of said finished articles are carried into said box through said chute and said hopper.

11. A fully automatic die casting machine as claimed in claim 6, wherein said packing device comprises a chute, a hopper and a conveyor for transporting the plurality of said boxes such that the predetermined amount of said finished articles are carried into said box through said chute and said hopper.

12. A fully automatic die casting machine as claimed in claim 1, wherein said recycling device comprises an elevator, a bucket movably provided in said elevator, a first chute for carrying the flash and said engageable portions into said bucket, a second chute for carrying into said melting furnace said engageable portions loaded in said bucket and driving means for driving said bucket.

13. A fully automatic die casting machine as claimed in claim 6, wherein said recycling device comprises an elevator, a bucket movably provided in said elevator, a first chute for carrying the flash and said engageable portions into said bucket, a second chute for carrying into said melting furnace said engageable portions loaded in said bucket and driving means for driving said bucket.

14. A fully automatic die casting machine as claimed in claim 4, wherein said coating device comprises a plurality of nozzles.

15. A fully automatic die casting machine as claimed in claim 5, wherein said coating device comprises a plurality of nozzles.

16. A fully automatic die casting machine as claimed in claim 6, wherein said coating device comprises a plurality of nozzles.

17. A fully automatic die casting machine as claimed in claim 7, wherein said driving device comprises a driving cylinder.

18. A fully automatic die casting machine as claimed in claim 9, wherein said driving member is a first cylinder.

19. A fully automatic die casting machine as claimed in claim 12, wherein said driving means is a second cylinder.

20. An apparatus for finishing an article integrally formed with an engageable portion into a finished article by removing flash on said article and said engageable portion from said article, including a fixed die and a movable die such that said article is molded in a first cavity defined between said fixed die and said movable die, either one of said fixed die and said movable die being provided with a second cavity for forming said engageable portion integrally with said article, said apparatus comprising:

a trimming die which is formed with a first opening for fitting said article thereinto and a second opening for fitting said engageable portion thereinto such that said article and said engageable portion are acommodated in said first opening and said second opening, respectively;

a retainer member for fixedly retaining in said second opening said engageable portion, said retainer member being a spring biased pawl arranged to prevent the engageable portion from exiting the trimming die in the direction in which it is inserted;

a driving device for retractably driving said trimming die between said fixed die and said movable die at the time of opening of said fixed die and said movable die; and a punching device which is pressed, when said trimming die is retracted away from between said fixed die and said movable die, against said article and engageable portion in said trimming die so as to remove said flash and said engageable portion from said article.

21. The invention of claim 20 wherein the second cavity includes a cylindrical section and a tapered section for forming the engageable portion with a cylindrical section adjacent the article and a tapered section of decreasing diameter extending outwardly from the cylindrical section.

22. The invention of claim 21 wherein the pawl includes a tapered section arranged to engage the tapered section of the engageable portion during the insertion of the article and engageable portion into the trimming die to guide the engageable portion into said second opening.

* * * * *